US005673793A

United States Patent [19]

Seidler

[11] Patent Number: 5,673,793

[45] Date of Patent: Oct. 7, 1997

[54] BLISTER PACK WITH BUILT-IN PRODUCT EJECTION SYSTEM

[76] Inventor: David Seidler, 69-10 108th St., Forest Hills, N.Y. 11375

[21] Appl. No.: 738,023

[22] Filed: Oct. 25, 1996

Related U.S. Application Data

[60] Provisional application No. 60/005,987, Oct. 27, 1995.

[51] Int. Cl.[6] ..... B65D 83/04

[52] U.S. Cl. ..... 206/531; 206/532; 206/804

[58] Field of Search ..... 206/469, 531, 206/532, 534, 538, 539, 804

[56] References Cited

U.S. PATENT DOCUMENTS 4,384,649 5/1983 Brodsky ..... 206/532

5,244,091 9/1993 Tannenbaum ..... 206/469

5,538,134 7/1996 Pitesky ..... 206/538

*Primary Examiner*—Paul T. Sewell

*Assistant Examiner*—Nhan Lam

*Attorney, Agent, or Firm*—Brown Raysman Millstein Felder & Steiner LLP

[57] ABSTRACT

A blister pack includes a frame defining least at one recessed compartment having an open side defining an opening for containing a product therein. A blister material covers the opening to removably seal the product in the compartment. A lever is pivotably supported by the frame over the opening with the lever being moveable to break the blister material and to scoop the product out of the compartment through the opening.

20 Claims, 3 Drawing Sheets

BLISTER PACK WITH BUILT-IN PRODUCT EJECTION SYSTEM

CROSS-REFERENCE TO RELATED PROVISIONAL APPLICATION

This application claims the benefit of U.S. provisional application Ser. No. 60/005,987 filed on Oct. 27, 1995.

BACKGROUND OF THE INVENTION

The present invention is directed generally to a blister pack of the type in which product such as tablets or cream are contained in recessed compartments behind a breakable film seal and, in particular, to such a blister pack which includes a built-in product ejection device which is used to scoop the product out of the compartment in which it is contained after the film seal has been broken.

Blister packs which support a plurality of tablets, capsules, pills, lotion, cream or other such product in individual recessed compartments formed in a thermoformed shell over which a film sheet such as foil or other pierceable material is provided, are well known. Many pills or other medicine, vitamins or the like are provided in such packages.

In order to remove the product from its compartment, the film or foil overlying the opening of the compartment must be pierced or otherwise broken to allow access to the product contained in the compartment therebelow. In some cases, pressing the tablet or other product through the deformable plastic against the film acts to press the product through the film allowing access thereto. In other situations where the foil is thick or otherwise where the product cannot be pressed through the foil, the foil must be pierced with a sharp object and then torn back to allow access to the product in the compartment. The compartments are generally formed in a thermoformed plastic material with a foil seal thereover.

Such blister packs are provided in order to ensure the integrity of the product contained therein and to provide a tamper resistant and tamper evident enclosure. In addition, such blister packs are provided as child resistant packages to prevent access to the tablets, capsules, pills, medication or other product contained in the compartment by children.

Another problem with such blister packs is experienced by the elderly, handicapped and lame who often find it difficult, if not in some cases impossible, to open such packages to obtain access to the product contained therein. This would be particularly true for those with arthritis or other motor control problems.

The present invention provides a product blister pack with built-in scoop ejection device which makes it easy and convenient to expel the product contained in blister packs, while continuing to provide tamper evident, tamper resistant and child resistant packaging.

SUMMARY OF THE INVENTION

Generally speaking, in accordance with the present invention, a blister pack having at least one compartment, but preferably a plurality of compartments, the openings of which are covered by a film seal, such as a foil seal, is provided. The blister pack includes a frame defining at least one recessed compartment having an open side defining an opening for containing a product therein. A blister material such as a film seal, foil seal or the like covers the opening to removably seal the product in the compartment. A lever is pivotably supported on the frame over the opening. The lever is movable to break the blister material and to scoop or otherwise eject the product out of the compartment through the opening.

In a preferred embodiment, the blister pack includes a plurality of compartments covered by a film seal. A panel includes a plurality of openings in the same general pattern as the layout of the compartments in the blister pack. A lever is supported by the sidewalls of each of the openings on the panel. The panel can be secured to the blister pack so that there is a correspondence between the openings in the panel and the compartments in the blister pack.

The levers are secured to the sidewalls of the openings by flexible, preferably integrally formed plastic straps or the like. The underside of each lever includes a piercing device which pierces the foil material when the lever is pressed downwardly toward the compartment. The lever can then be pivoted to scoop the product out of the compartment.

The straps may be constructed to retain the lever on the panel after scooping, or may be such as to allow breakaway of the lever after scooping for disposal.

Accordingly, it is an object of the present invention to provide an improved blister pack.

Another object of the present invention is to provide a product blister pack with a built-in ejection device.

A further object of the present invention is to provide a blister pack with built-in scoop device which provides the product protection, evidence of tampering and resistance to tampering found on regular blister packs with an inexpensively manufactured and easily constructed device which allows ready removal of the product from the blister pack.

A still further object of the present invention is to provide a blister pack with built-in scoop device which while easy to use for those with dexterity difficulties, is difficult to use by children thereby making it child resistant.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
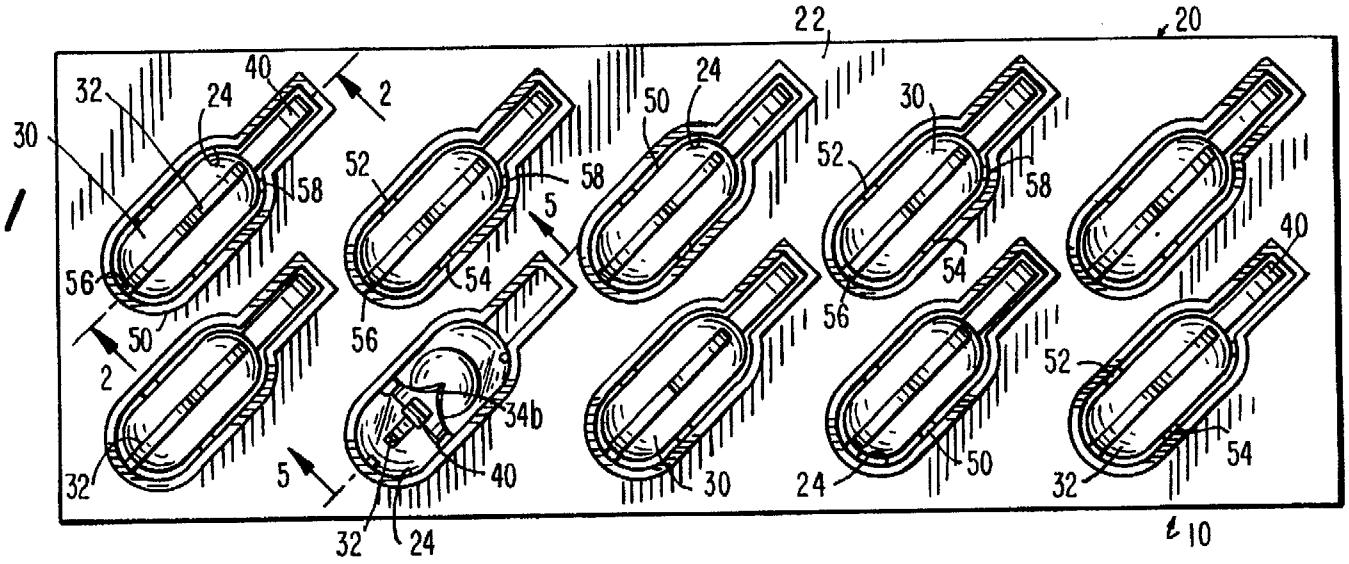
FIG. 1 is a top plan view of a blister pack with built-in product ejection system constructed in accordance with a preferred embodiment of the present invention.
Figure 2:
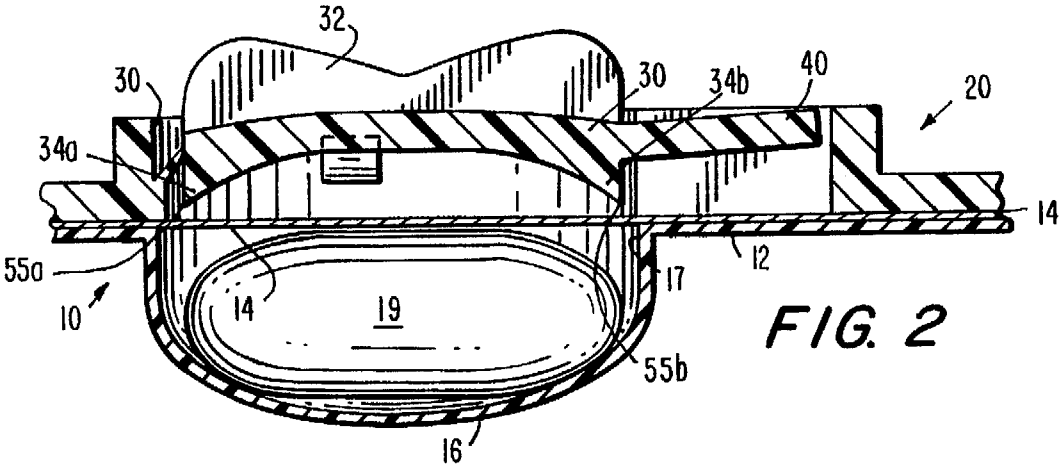
FIG. 2 is an enlarged sectional view taken along line 2—2 of FIG. 1.

Reference is first made to FIGS. 1 and 2 of the drawings which depict a blister pack, generally indicated at 10 shown incorporating a built-in ejection system, generally indicated at 20 also constructed in accordance with a preferred embodiment of the present invention.

The blister pack 10 used in conjunction with the present invention is a multiple compartment thermoformed plastic product casing 12 having a film seal 14 thereover. Film seal 14 may be formed or other such pierceable material which can be secured to product casing 12 to seal the product in their respective compartment. Product casing 12 defines a plurality of recessed compartments 16 each having an open side defining an opening 17. Film seal 14 is secured by known conventional means to overlie each of openings 17 to seal product 19 in respective compartments 16. In the embodiment depicted, product 19 is a pill in the form of a tablet, but it is noted that other forms of solid material such as capsules or the like may fill compartments 16, or viscous material such as cream or the like may be found in compartment 16 to comprise product 19.

It is noted that blister pack 10 is formed in the conventional manner, first by thermoforming a plastic material with a plurality of depressions therein, then filling each of the depressions with the desired product, and then sealing a film such as a foil material seal on the upper surface of the thermoformed panel to cover each of the openings defined by the compartments, to secure the product therein.

In accordance with a preferred embodiment of the present invention, an ejection system 20 is separately formed and then applied to the blister pack. It is noted however that the present invention should not be construed as limited to a separate construction for the ejection system and it is envisioned that it may be formed as part of the blister pack itself. The construction of the ejection system with scoop device will now be described in detail.

Device 20 includes a panel 22 having a plurality of paddle shaped openings 24 formed therein. It is noted that openings 24, although paddle shaped in the drawings, may be formed in different shapes, depending on the requirements of the scoop device, as will hereinafter be described.

Each opening 24 is positioned on panel 22 so as to overlie a compartment 16 in blister pack 10 as depicted in FIG. 2, for example, and as will more fully be explained hereinafter described. A lever 30, which may be, but is not required to be, paddle shaped as depicted in the drawings is provided in each opening 24.

Lever 30 includes a main scoop portion 32 and a handle extension 40. Main scoop portion 30 includes an upwardly extending flange 32 on the upper surface thereof, and opposing scoop shaped portions **34*a* and 34*b* on the lower surface thereof which preferably include piercer tips 55*a* and 55*b*, respectively. Lever 30 is coupled to sidewall 50 of opening 24 by means of opposing strap or living hinge connectors 52 and 54 which as depicted are in the form of integrally formed plastic straps. Lever 30 is also coupled using breakaway stabilizers 56 and 58**, also preferably in the form of integrally formed plastic strips, preferably positioned as depicted in the drawings.

Referring now additionally to FIGS. 3 through 6, the operation of the present invention will be described.

After panel 22 is formed as depicted in FIG. 1, it is secured to the upper surface of blister pack 10 so that openings 24 correspondingly overlie each of the compartments formed in blister pack 10. Panel 22 may be coupled to blister pack 10 by any appropriate means such as by heat sealing, rivets, gluing or other adhesives, or ultrasonic means, or the like. Panel 22 is preferably injection molded and is inexpensive and easy to manufacture.

Figure 3:
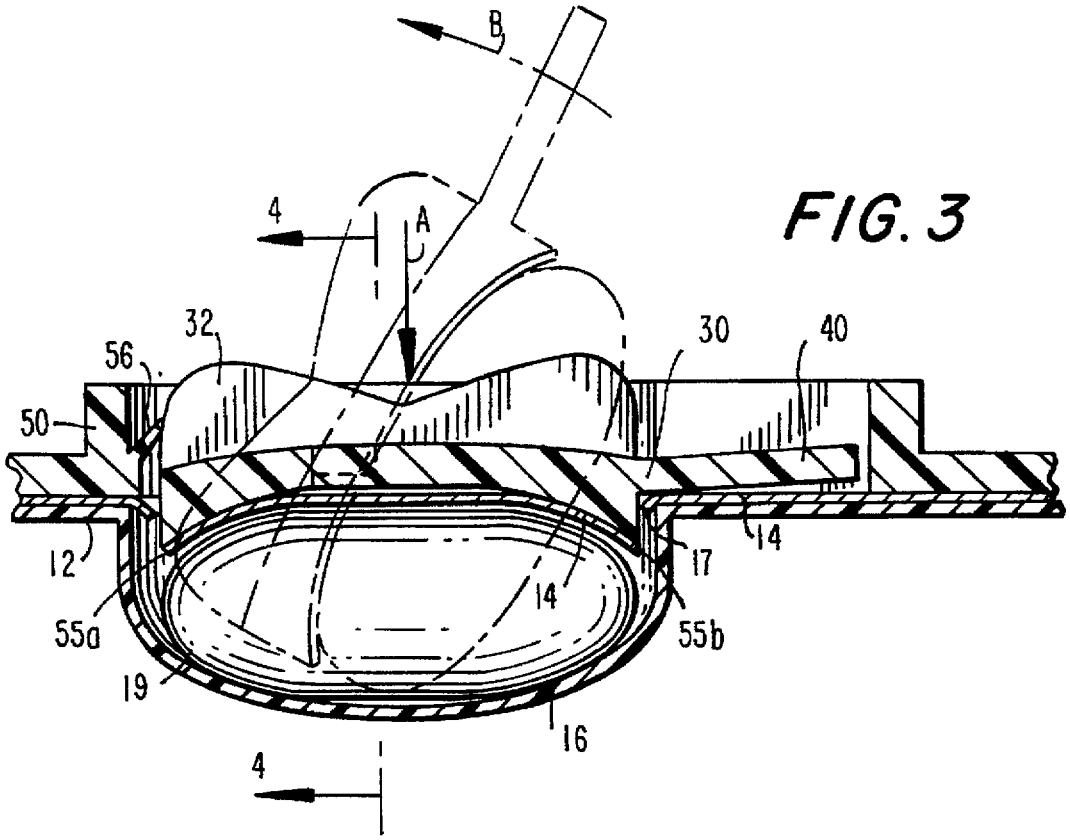
FIG. 3 is a sectional view similar to FIG. 2 but showing the scoop device after it has pierced the foil material and also showing pivoting of the scoop device in phantom.
Figure 4:
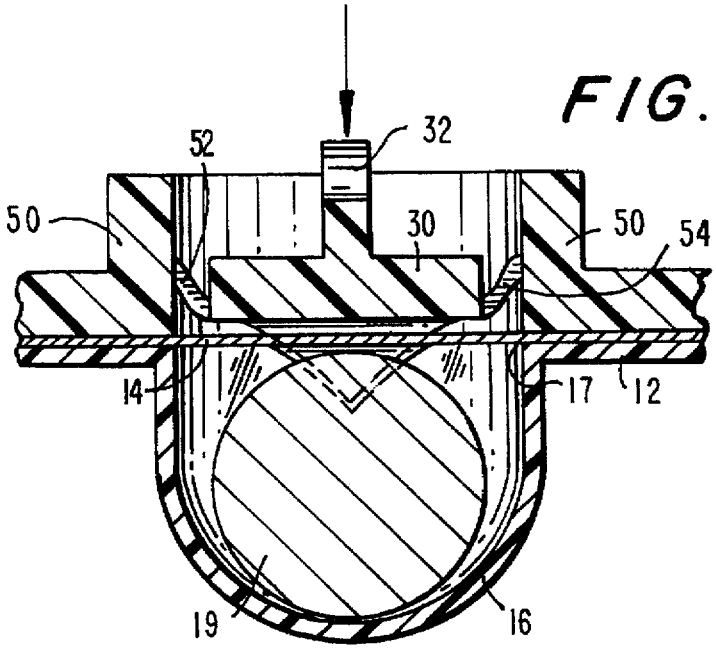
FIG. 4 is a sectional view taken along line 4—4 of FIG. 3.
Figure 5:
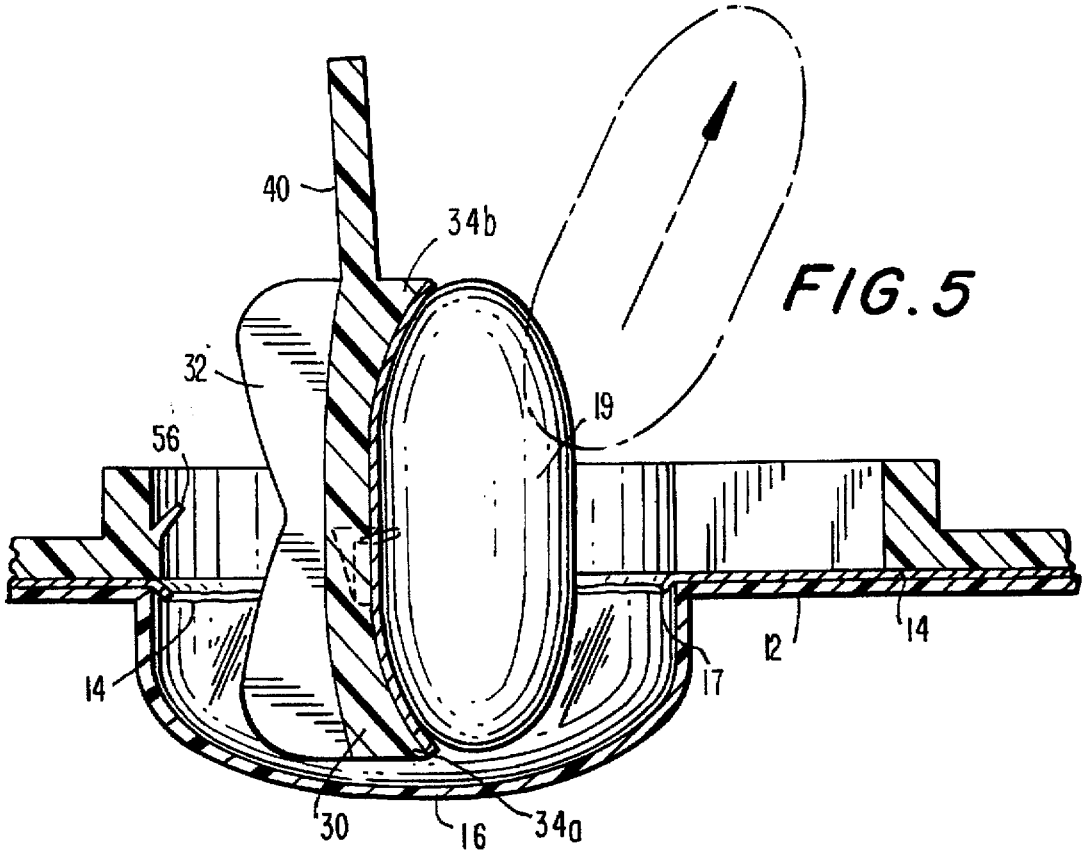
FIG. 5 is an enlarged sectional view taken along line 5—5 of FIG. 1.
Figure 6:
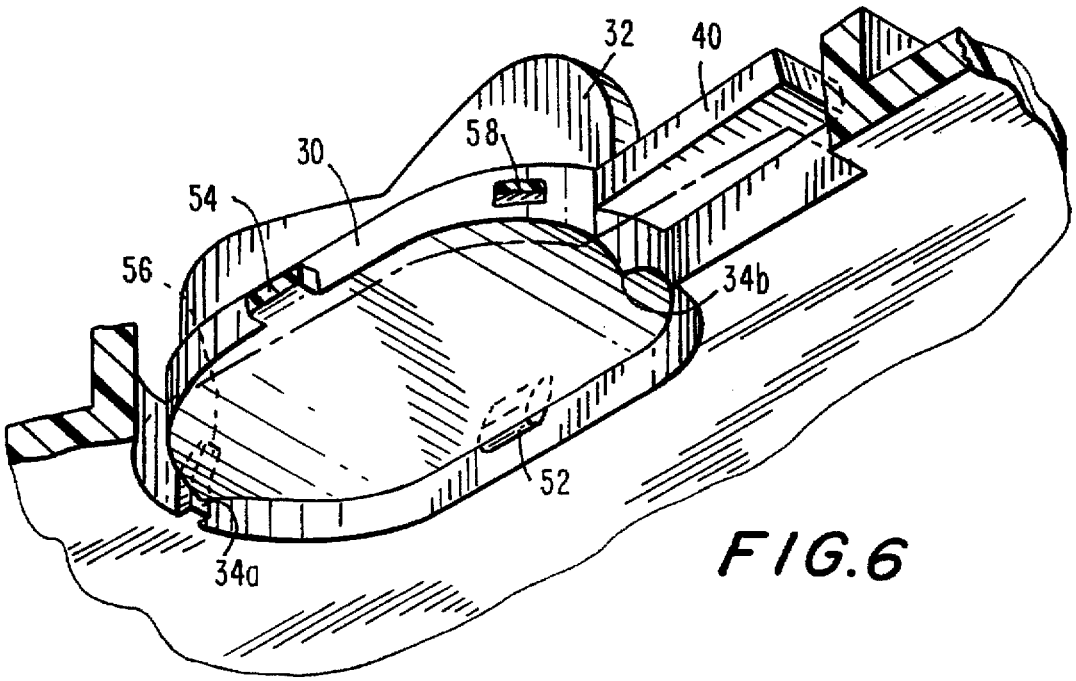
FIG. 6 is a partially cut away bottom perspective view of one of the ejection devices.

FIG. 2 depicts the situation before actuation of lever 30 in the standby or pre-piercing position. Note that foil film 14 seals product 19 in compartment 16, and that handle 40 is not directly positioned over the depression forming the compartment. In FIG. 3, it is shown that when downward pressure is applied in the direction of arrow A on flange 32, scoop portions **34*a* and 34*b* will pierce through film 14, as also shown in FIG. 4. Handle 40 can then be grasped and pulled upwardly in the direction of arrow B whereby breakaway stabilizers 56 and 58 will break off thereby allowing pivoting movement about the axis defined by straps 52 and 54 which remain attached to lever 30. As pivoting is continued in the direction of arrow B, as best shown in phantom in FIG. 3 and continued through in FIG. 5, forward end scoop 34*a* will press scoop and product 19 in the form of a tablet, for example, in an upward direction so that product 19 is pivoted out of compartment 16 and is available for finger grasping or other removal from compartment 16**.

It is noted that straps 52 and 54 may be constructed so as to remain attached to lever 30 whereby lever 30 remains attached to the package after pivoting. In this case, lever 30 can be moved to its original position and retained there for disposal with the entire blister package after each of the compartments has been emptied. Alternatively, straps 52 and 54 may be constructed such that they break away after pivoting of lever 30 whereby lever 30 may be separately disposed of.

In accordance with the foregoing, the present invention provides a blister pack with a built-in product ejection system wherein a scoop device panel may be separately formed and then applied to a conventional blister pack to allow easy opening of the compartments in the blister pack and scooping out of the product contained in each compartment of the blister pack by even those who generally have difficulty opening such blister packs, while providing difficulty for children to open such packs. Thus, the present invention provides a blister pack with built-in scoop device which while inexpensive and easy to manufacture, is tamper proof and tamper evident, child resistant, yet easy to use and manufacture.

It will thus be seen that the objects set forth above, among those made apparent from preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A blister pack comprising a frame defining at least one recessed compartment having an open side defining an opening for containing a product therein, a blister material covering said opening to removably seal said product in said compartment, a lever pivotably supported by said frame over said opening, said lever being moveable to break said blister material and to scoop said product out of said compartment through said opening.

2. The blister pack as claimed in claim 1, wherein said lever is displaceable against said blister material to pierce said blister material, said lever being pivotable after piercing said blister material to scoop said product at least partially out of said compartment.

3. The blister pack as claimed in claim 2, wherein said lever includes a flange on an upper surface thereof to allow said lever to be pressed against said blister material to pierce said blister material.

4. The blister pack as claimed in claim 2, wherein said lever includes at least one scoop shaped portion on the lower surface thereof.

5. The blister pack as claimed in claim 4, wherein said lever includes at least a second scoop shaped portion on the lower surface thereof.

6. The blister pack as claimed in claim 5, wherein said at least one and second scoops include a piercing tip.

7. The blister pack as claimed in claim 1, wherein said frame includes a panel overlying said blister material, said panel including at least one opening in alignment with said at least one compartment, said lever being supported by said panel in said panel opening.

8. The blister pack as claimed in claim 7, wherein said panel is formed from a thermoplastic material, said lever being formed with said panel and attached to the sidewall defining said panel opening by integrally formed straps.

9. The blister pack as claimed in claim 8, wherein said lever includes a main scoop portion and a handle which extends therefrom.

10. The blister pack as claimed in claim 8, wherein said integrally formed straps include at least one breakaway stabilizer strip and at least two opposing strap connectors, said strap connectors defining the pivot axis of said lever.

11. A product ejection system for a blister pack, said blister pack including a plurality of compartments each of which includes product therein, and a film material overlying said compartments, the system comprising a panel formed from a thermoplastic material adapted to be secured to said blister pack, said panel including a plurality of openings therein positioned to correspond to the compartments in said blister pack, each opening being defined by a sidewall, a scoop positioned in each said opening and pivotably coupled to said sidewall, said scoop including a piercing device to pierce said film material, said scoop being pivotable after piercing of said film material to scoop product out of said compartment, said panel being coupleable to said blister pack so that said respective scoop can be used to pierce and eject product out of a corresponding compartment.

12. The product ejection system as claimed in claim 13, wherein said straps permit movement of said scoop towards said compartment to pierce said film material and permit pivoting movement to scoop said product out of said compartment.

13. The product ejection system as claimed in claim 11, wherein said scoop is coupled to said sidewall by straps.

14. The product ejection system as claimed in claim 13, wherein said straps are integrally formed with said panel and scoops.

15. The product ejection system as claimed in claim 14, wherein said straps define a pivoting axis for said scoop.

16. The product ejection system as claimed in claim 15, wherein said scoop includes a flange on the upper surface thereof.

17. The product ejection system as claimed in claim 15, wherein said scoop includes at least one extension on the lower surface thereof, said extension including a piercing tip.

18. The product ejection system as claimed in claim 15, wherein said lever is further coupled to said sidewall by a breakaway strip.

19. The product ejection system as claimed in claim 11, wherein said scoop is elongated and includes a forward end and rear end, said rear end including a handle.

20. The product ejection system as claimed in claim 19, wherein said piercing device includes piercing portions at said forward end and said rear end.

* * * * *